United States Patent [19]

Freestone et al.

[11] Patent Number: 5,058,257

[45] Date of Patent: Oct. 22, 1991

[54] TOOL FOR INSERTING AND REMOVING PIN FOR BUCKET TOOTH

[76] Inventors: David W. Freestone, 725 S. Oracle, Mesa, Ariz. 85204; Thomas W. Borter, 8626 E. Montebello Ave., Scottsdale, Ariz. 85253

[21] Appl. No.: 447,624

[22] Filed: Jan. 16, 1990

Related U.S. Application Data

[63] Continuation of Ser. No. 307,767, Feb. 7, 1989, abandoned, which is a continuation-in-part of Ser. No. 172,810, Mar. 28, 1988, abandoned.

[51] Int. Cl.[5] ..... B25B 27/14

[52] U.S. Cl. ..... 29/275

[58] Field of Search ..... 81/463; 29/275, 276, 29/254, 255, 280, 283

[56] References Cited

U.S. PATENT DOCUMENTS

| | | | |
|---|---|---|---|
| 1,355,631 | 10/1920 | Welbrook | 29/276 |
| 3,268,991 | 8/1966 | Beinhaur | 29/254 |
| 3,999,275 | 12/1976 | Schmidt | 29/275 |
| 4,188,701 | 2/1980 | Ludwig | 29/275 |

*Primary Examiner*—Robert C. Watson

*Attorney, Agent, or Firm*—H. Gordon Shields

[57] ABSTRACT

Pin insertion and removal tool includes a main block and a holder cup or socket for holding a pin to be inserted to secure a tooth onto a shank of a bucket. The holder cup or socket is secured to a holder block which is in turn secured to the main block. An extractor pin is secured to an extractor block, and the extractor block is secured to the main block. Both the extractor pin and the holder cup or socket are spaced apart from the main block by predetermined distances. The main block includes impact portions which receive hammer blows to set the pin and to remove the pin, as required. Adjacent to the holder cup or socket is a pin setting face that is used to completely insert the pin after it has been started and is sufficiently into the tooth and shank to remove the socket and tool from the pin and to move the tool slightly to provide direct force against the pin for setting the pin by hammer blows on the pin setting impact portion of the main block.

19 Claims, 2 Drawing Sheets

TOOL FOR INSERTING AND REMOVING PIN FOR BUCKET TOOTH

CROSS-REFERENCE TO RELATED APPLICATION

This application is a continuation of application Ser. No. 307,767, filed 2/7/89 now abandoned, which is a continuation-in-part application of copending application Ser. No. 07/172,810, filed 3/28/88, and now abandoned.

BACKGROUND OF THE INVENTION

1. Field of the Invention

This invention relates to digging buckets, such as back hoe buckets, which include shanks secured to the bucket and to teeth or caps which fit over the shanks and are secured to the shanks by pins and, more particularly, to a tool for inserting and removing the pins to secure and to remove the teeth or caps to or from the shanks.

2. Description of the Prior Art

U.S. Pat. No. 1,355,174 (Shepard) discloses a cotter pin extractor tool. The cotter pin extractor tool includes a pair of relatively pointed tip elements for making contact with cotter pins, and an offset portion, between the tips, for receiving hammer blows for extracting the cotter pins. One of the tips may be used to spread apart or to straighten the tip of cotter pins, while the other tip is used primarily to hook the eye of a cotter pin for extracting the pin.

U.S. Pat. No. 2,089,902 (Kulp) discloses a valve guide driver in which the body of the tool is offset from the handle of the tool. The handle is impacted by a hammer rod to drive a valve guide into its bore.

U.S. Pat. No. 2,359,677 (Reeves) discloses an impact tool for removing various types of elements from a shaft. The apparatus includes a working end offset from the impacting portion. The impacting portion includes a relatively long shaft and a circular or enlarged end, while the working end is illustrated in several different embodiments. The working end is offset from the shaft and the enlarged portion.

U.S. Pat. No. 2,860,408 (Woyton) discloses a muffler tail pipe removing tool which includes an elongated handle, a blade portion which is substantially perpendicular to the elongated handle, and an impact striking portion adjacent to the blade portion, but offset from and generally parallel to the blade portion. The impact portion is secured to the handle.

U.S. Pat. No. 3,290,769 (Kashergen) discloses a tool used to change a digging tooth by the camming action of a bifurcated arm. The tool includes a handle, with an impact surface at the end of the handle. The handle and the impact or striking face is offset from the bifurcated arm. The bifurcated arm is of varying techniques to provide the camming action as the tool is driven by the impact from a hammer for removing the digging tooth.

U.S. Pat. No. 4,185,372 (Dupree et al) discloses an impact device for removing a key from a keyway. The tool or device includes a striking face which is parallel to, but offset from, the key removal portion.

U.S. Pat. No. 4,501,079 (Hahn et al) discloses a multiple cutting edge tool which includes pins and tools for removing and inserting the pins. The tool may be inverted for different uses. There is an impact surface that is parallel to the line of the tool, but offset from the actual working portion of the tool, regardless of whether the tool is inverted or not.

It is obvious that the above-described tools are very specialized tools and accordingly have limited applications. The apparatus of the present invention is also a very specialized tool and accordingly has limited application. Structurally, the apparatus of the present invention is substantially different from any of the tools discussed above, and comprises a relatively simple, but highly effective, tool for inserting and for removing pins used to secure a tooth to the shank of a bucket.

With respect to the insertion and removal of pins for the teeth and shanks of digging buckets, the prior art simply consists of pliers, such as "vise-grip" types for insertion, a drift punch of some type, and a hammer. Since the shanks are so close together, it is virtually impossible to provide a direct line of force to either insert or to remove a pin. Accordingly, a substantial amount of time is utilized in providing sufficient force in the attempts to properly insert and to remove the pins for changing the digging teeth.

The apparatus of the present invention provides a relatively simple, inexpensive, and very effective tool for inserting and removing the pins.

SUMMARY OF THE INVENTION

The invention described and claimed herein comprises a tool having a pair of impact surfaces, with offset elements. The offset elements include a socket for holding a pin and a pin impact surface adjacent to the socket, for holding and then for setting a pin, and a pin removal offset portion for removing set pins. The distances from the impact portion of the tool to the working portions of the tool are predetermined so that the impact portion may be disposed on the tooth to be removed or to be secured, and accordingly to act as a guide for the tool.

Among the objects of the present invention are the following:

To provide new and useful pin inserting apparatus;

To provide new and useful pin removal apparatus;

To provide new and useful tool apparatus having an impact portion and a pair of offset portions, with one offset portion for removing a pin and another offset portion for inserting a pin;

To provide new and useful tool apparatus for holding and setting a pin; and

To provide new and useful tool apparatus having a socket for holding a pin and an impact receiving portion offset from the socket portion.

DESCRIPTION OF THE PREFERRED EMBODIMENT

Figures 1, 2, 3, 4, 5, 6:
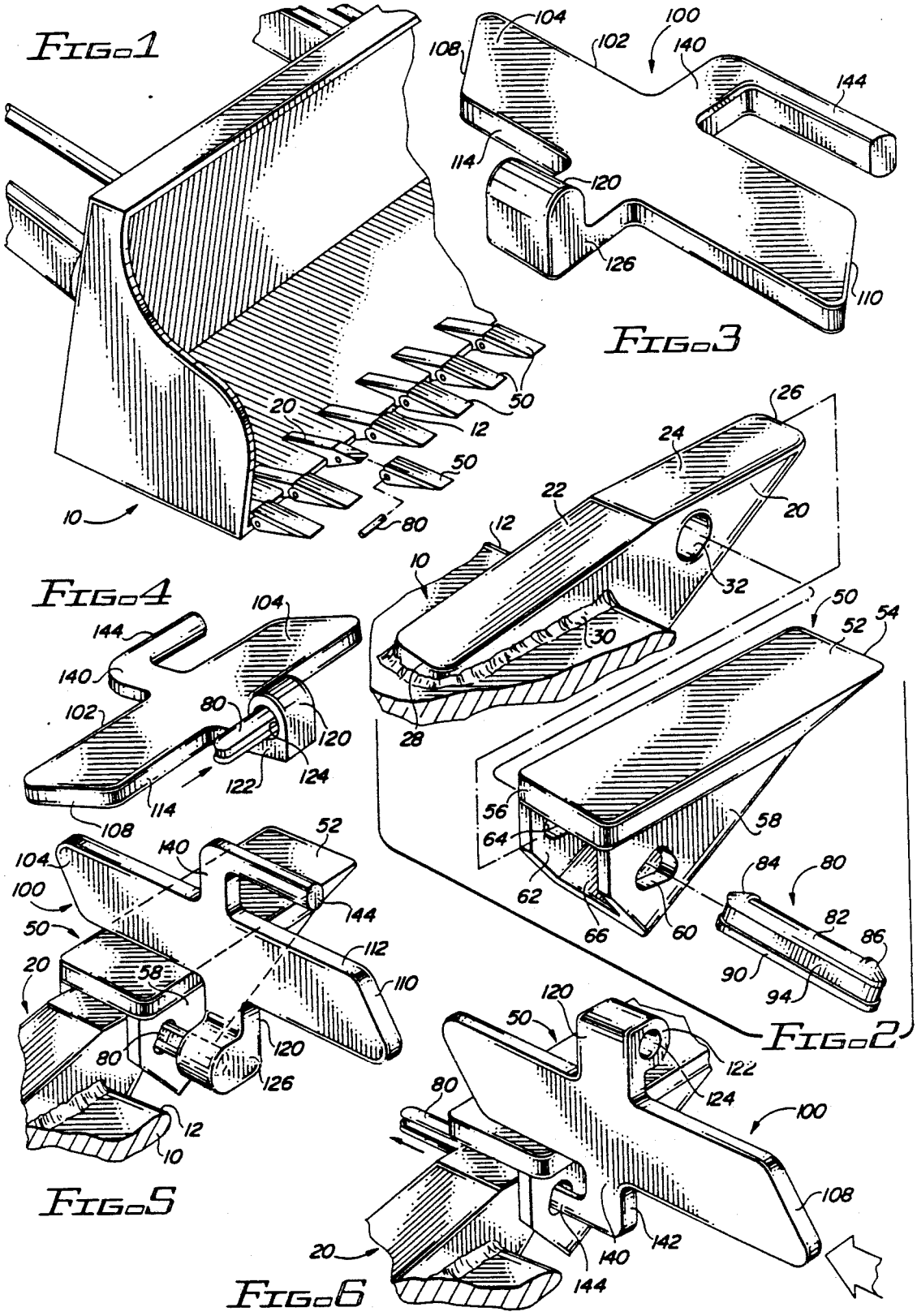
FIG. 1 is a perspective view of the use environment of the apparatus of the present invention.
FIG. 2 is an enlarged perspective view illustrating the use environment of the apparatus of the present invention.
FIG. 3 is a perspective view of the apparatus of the present invention.
FIG. 4 is a perspective view of the apparatus of the present invention with a pin inserted therein.
FIG. 5 is a perspective view illustrating the operation of one portion of the apparatus of the present invention.
FIG. 6 is a perspective view of the operation of another portion of the apparatus of the present invention.

FIG. 1 is a perspective view of a bucket 10, which is the use environment of the apparatus of the present invention. The bucket 10 includes a front digging edge 12. Extending outwardly from the front edge 12 is a plurality of shanks 20. The shanks 20 are welded to the bucket 10. A tooth or cap 50 is disposed over each shank, and is secured to the shank by a pin 80. Each shank includes a removable tooth 50, and each tooth 50 is secured to its shank by a pin 80.

In digging with the bucket 10, the removable teeth 50 become worn and they are replaced as they are worn. The use of the replaceable teeth prevents the shanks 20 wearing out.

In FIG. 2, which is a rear perspective view of a portion of the bucket 10 and its front edge 12, a shank 20 is shown appropriately secured to the bucket by a weld bead 30. As best shown in FIG. 2, the shank 20 is of a generally triangular configuration, with a rear top portion 22, which is generally flat, and a front top face portion 24, which is also flat. There is a slight angle between the top portions 22 and 24.

The front top face portion 24 extends to a front edge 26. Extending downwardly and rearwardly from the front edge 26 is a generally flat bottom face, not directly shown. As is understood, although not explicitly shown, the shank includes a slot extending inwardly from a rear edge 28, which is at the rear portion of the top. The rear edge 28 is at the back part or portion of the rear top portion 22. The slot receives the front edge 12 of the bucket 10. The weld covers the slot on the top and bottom of the bucket to secure the shank to the bucket 10.

Extending laterally or transversely through the shank 20 is an aperture or bore 32. The aperture or bore 32 receives the pin 80 to secure the tooth 50 to the shank 20.

A tooth 50 is shown spaced apart from the shank 20. The tooth 50 obviously conforms to the general configuration of the shank 20.

The tooth 50 is hollow, and is of a generally triangular configuration, with plates which conform to, and thus receive, the shank 20. The tooth includes a top plate 52. The top plate 52 includes a front edge 54 and a rear edge 56. The front edge 54 is relatively "sharp" in that it represents the front or digging edge for the bucket 10.

Extending generally downwardly from the bottom of the top plate 52 are side plates 58 and 62. The side plates are of a generally triangular configuration to, as indicated above, conform to the generally triangular configuration of the shank 20. The side plate 58 includes an aperture 60 extending through it, and the side 62 includes an aperture 64 extending through it. The apertures 60 and 64 are generally aligned with each other, and they are aligned with the aperture 32 extends through the shank 20 when the tooth 50 is placed on the shank 20. The three aligned apertures are also generally parallel to the top surface of the plate 52.

A pin 80 is also shown in FIG. 2 spaced apart, but aligned with, the aperture 60 and 64. The pin 80 is made in three portions, including a pair of spaced apart plates 82 and 90 and a rubber or elastomeric center portion 94. The top plate 82 includes an upwardly extending end 84 and an upwardly extending end 86. The ends 84 and 86 are at the opposite ends of the plate 82. The ends 84 and 86 are tapered so as to extend or fit relatively easily through the aligned apertures. The ends generally have an inwardly extending portion to help them hold onto the tooth and shank.

The bottom plate is generally smooth or flat for its full extent or length. The length of the pin 80 between the ends 84 and 86 is about the width of the tooth 50 between the outside face of the side plates 58 and 62.

The rubber center section 94 allows the pin 80 to be compressed so that it fits through the aligned apertures 60, 32, and 64. Then, when the end 84, as shown in FIG. 2, extends outwardly from the aperture 64, the pin 80 expands to its full height and is locked to the tooth 50 and the shank 20 to secure the two elements together.

It will be understood that there are different designs for pins, and the apparatus of the present invention is designed to work with virtually all of them. However, only a single, and relatively common, design is shown and discussed.

The apparatus of the present invention is illustrated in FIGS. 3, 4, 5, and 6. For the following discussion, reference will be made primarily to FIGS. 3, 4, 5, and 6.

Tool apparatus 100 of the present invention is shown in a rear perspective view in FIG. 3, and in a front perspective view in FIG. 4, the tool 100 is shown in its particular employment in FIGS. 5 and 6. In FIG. 5, the tool is used to insert a pin 80 through a tooth 50 and a shank 20, and in FIG. 6 the tool 100 is shown being used to extract the pin 80 from the tooth 50 and the shank 20.

The tool 100 includes a main block 102, which is a generally flat block of steel, or the like. The block 102 includes two generally flat side surfaces, including a side surface 104. The tool apparatus 100 also includes a pair of impact faces, a front impact face 108 and a rear impact face 110. The faces 108 and 110 are slightly slanting with respect to the longitudinal axis of the tool 100, and are generally parallel to each other. The block 102 also includes a pair of surfaces, a top surface 112 and a bottom surface 114. The terms "top" and "bottom" are merely terms of convenience, since the "top" and the "bottom" pertain more to the particular manner in which the apparatus is used than to a specific orientation.

A holder block 120 extends downwardly from the "bottom" surface 114. The holder block 120 includes a front setting face 122, which comprises the front face of the holder block 120. Extending outwardly from the side of the holder block 120 is a socket 124. The socket 124 has a longitudinal axis that is generally parallel to the surface 114. The length of the socket 124 is substantially less than the length of the pin 80 so that the pin 80 extends out of the socket a substantial distance, as shown in FIG. 4. A rear face 126 of the block 120 and socket 124 is generally parallel to the front, setting face 122.

In setting a pin 80, the pin 80 is initially disposed within the socket 124, as shown in FIGS. 4 and 5. As specifically shown in FIG. 5, the pin 80 is then disposed within the aperture 60. The bottom surface 114 of the tool 100 is disposed on, or rests against, the top surface 52 of the cap 50. Thus, the spacing between the socket 124 and the bottom surface 114 is appropriately dimensioned for the tooth 50 to allow the surface 114 of the tool 100 to be disposed on the tooth 50 while the pin 80 is being inserted and set.

After one or more hammer blows against the rear striking face 110, the pin 80 will have been extended into the cap 50 and the shank 20 as far as it can go, or until the setting face 122 is disposed against the side 58. At that time, the tool 100 will be pulled away from the pin 80 to remove the pin from the tool in order to reorient the tool with respect to the pin 80. Since the pin 80 is not yet fully inserted, the tool 100 will simply be moved over until the setting face 122 is disposed against the pin 80.

It will again be noted that, as the tool 100 is moved back or rearwardly and laterally, until the setting face 122 is disposed against the pin 80, the bottom surface 114 still rests on the top plate 52 of the tooth 50. Hammer blows are again directed against the striking face 110 until the pin 80 is fully inserted into the tooth 50 and the shank 20.

For extracting a pin, as when a tooth is worn out, the tool apparatus 100 is inverted from that shown in FIG. 5, to the orientation shown in FIG. 6. The tool 100 includes an extractor block 140 which extends upwardly from the top surface 112. An extractor pin 144 extends outwardly from the extractor block 140 generally parallel to the top surface 112. The extractor pin 144 is spaced apart from the surface 112 a distance which is generally the same as the distance between the bottom surface 114 and the socket 124, or the distance between the top plate 52 and the aligned apertures 60, 32, and 64. When the top surface 112 is disposed on the plate 52, the extractor pin 144 is aligned with the pin 80.

With the extractor pin 144 aligned with the pin 80, as shown in FIG. 6, hammer blows directed against the face 108 will cause the pin 80 to be removed from the tooth 50 and the shank 20 in substantially the same manner as it was inserted. That is, the pin 80 will compress slightly as it is forced outwardly from the tooth and shank. In actuality, of course, it is the rubber center 94 of the pin 80 which compresses and not the plates 82 or 90.

Figure 7:
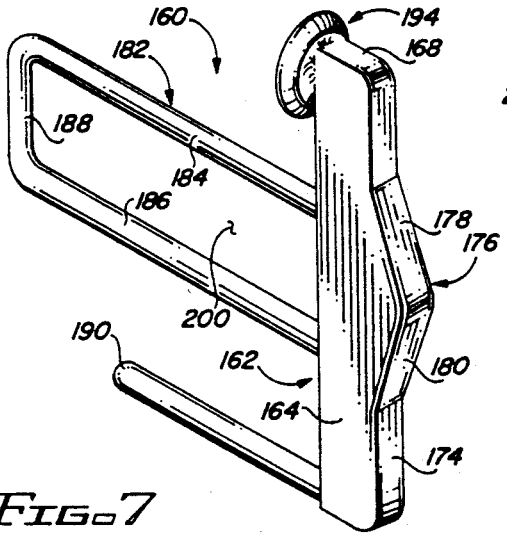
FIG. 7 is a perspective view of an alternate embodiment of the apparatus of the present invention.

FIG. 7 is a perspective view of alternate tool apparatus 160 of the present invention. The tool apparatus 160 is utilized for teeth that use snap rings instead of rubber centers, as discussed above in conjunction with the apparatus 100.

The apparatus 160 includes a main block 162 having a side surface 164, a side surface 166, a top surface 168, and a bottom surface 170. The main block 162 also includes a front face 172 and a rear face 174.

Extending outwardly from the rear face 174 is a striking block 176. The striking face 176 includes two striking faces, an upper striking face 178 and a lower striking face 180. The striking faces 178 and 180 are angularly oriented, as are the striking faces 108 and 110 of the apparatus 100 discussed above. The upper striking face 178 may also be designated as an extractor striking face, and the lower striking face 180 may also be designated as a pin setting striking face. This will be discussed in more detail below.

Extending outwardly from the front face 172 is a reference block 182. The reference block 182 includes three elements, an upper reference arm 184, a lower reference arm 186, and an outer connecting arm 188.

Also extending outwardly from the front face 172 is an extractor pin 190. The extractor pin 190 is disposed adjacent to the bottom 170 of the main block 162.

The distance between the lower reference arm 186 in extractor pin 190 is dimensioned to be approximately the longest or greatest distance expected between the top of a tooth and a pin. Thus, for extracting purposes, the lower reference arm 186 is disposed on the top of a tooth and the outer end of the extractor pin 190 is disposed adjacent to a locking pin in order for the pin to be removed to remove the tooth from the shank. If the distance between the pin and the top of the tooth is less than the direct distance between the reference arm 186 and the extractor pin 190, then the tool apparatus 160 is simply disposed at an angle until the reference arm 186 is disposed on the top of a tooth, and the outer end of the pin 190 is still disposed against the locking pin that holds the tooth to the shank.

With the tool 160 in position for removing the locking pin, the upper striking face 178 is struck with a hammer. The purpose of having the striking face 178 not directly aligned, or perpendicular, to the axis of the extractor pin 190 is that the angular orientation of the striking face prevents bounce which may cause the extractor pin 190 to be moved away from the pin that it is trying to extract from the tooth and shank.

It will be noted that the overall length of the reference block 182 is longer than the extractor pin 190. This is, of course, necessary so that the reference block, or the lower arm 186 of the reference block 182, may be disposed conveniently and appropriately on the top of the tooth during the beginning of the extraction process.

A holder boss 194 extends outwardly from the upper portion of the main block 162 adjacent to the top surface 186. Within the holder boss 194 is a holder socket 196.

When setting a pin to secure a tooth to a shank, the pin to be set is disposed in the holder socket 196, and the upper reference arm 184 of the reference block 182 is disposed on the top of the tooth, substantially in the same manner as discussed above for the tool apparatus 100 and comparable to the above description for the removal of a pin using the reference arm 186 and the extractor pin 190. Again, if the distance between the holder socket 196, and a pin disposed therein (not shown) is less than the distance between the upper arm 184 and the pin in the socket 196, then the tool apparatus 160 is tilted until the arm 182 is conveniently disposed on the top of the tooth.

With the pin to be held within the socket 196 and in its aperture in the tooth, and appropriately aligned with the aperture in the shank, the setting striking face 180 is struck with the hammer until the pin is appropriately set. It will be noted, in the embodiment of tool apparatus 160, that the socket 196 is directly aligned with the upper portion of the main block 162. Accordingly, the pin may be left within the socket 196 during the entire setting process.

Within the reference block 182 is a space 200. The space 200 is defined by the main block 162 and the three elements 184, 186, and 188 which comprise the reference block 182, the space 200 conveniently receives the fingers of a user for purposes of holding the apparatus 160 while striking the faces 178 and/or 180. Actually, either the upper reference arm 184 or the lower reference arm 186 will be held by a user during the extraction and setting procedures.

Figure 10:
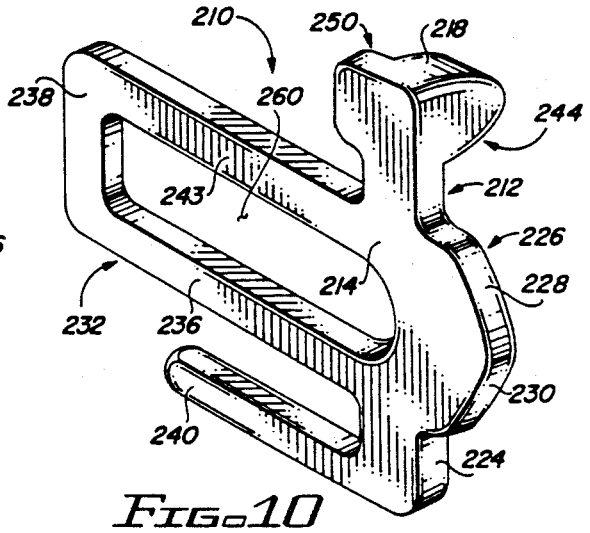
FIG. 10 is a perspective view of another alternate embodiment of the apparatus of the present invention.
Figure 8:
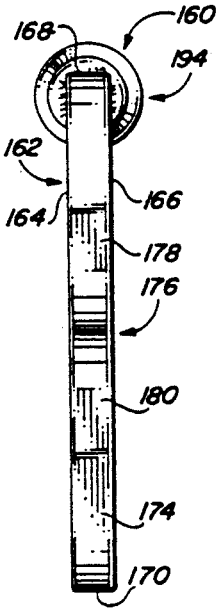
FIG. 8 is a rear end view of the apparatus of FIG. 7.
Figure 9:
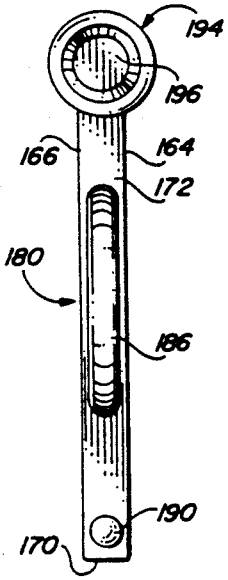
FIG. 9 is a front end view of the apparatus of FIG. 7.

FIG. 10 is a perspective view of another alternate embodiment, comprising tool apparatus 210. The tool apparatus 210 includes a main block 212, a striking block 226, a reference block 232, and a holder boss 244.

Figure 11:
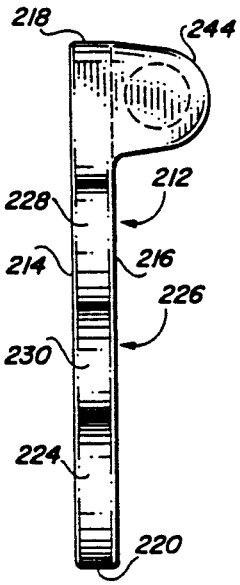
FIG. 11 is a rear end view of the apparatus of FIG. 10.
Figure 12:
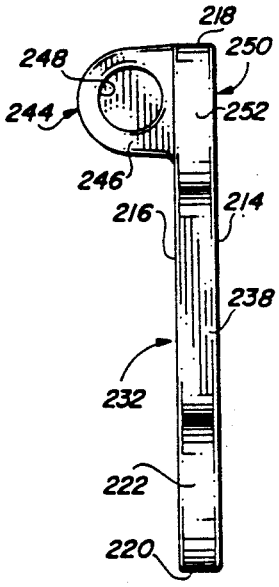
FIG. 12 is a front end view of the apparatus of FIG. 10.
Figure 13:
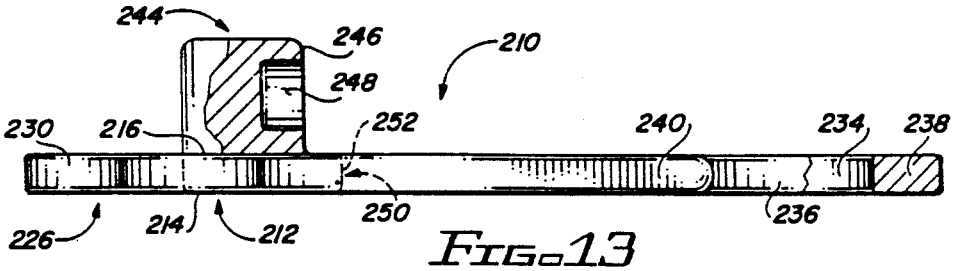
FIG. 13 is a bottom view, partially broken away, of the apparatus of FIG. 10.

FIG. 11 is a rear end view of the tool apparatus 210, illustrating a portion of the main block 212, the striking block 226, and the holder boss 244. FIG. 12 is front end view of the tool apparatus 210, including the main block 212, the reference block 232, and a front view of the holder boss 244. FIG. 13 is a bottom view of the tool apparatus 210, showing the main block 212, and with portions of the reference block 232 and the holder boss 244 broken away. The striking block 226 is also shown in FIG. 13.

For the following discussion, reference will primarily be made to FIGS. 10, 11, 12, and 13.

The main block 212 of the tool apparatus 210 includes a pair of sides 214 and 216, a top 218, and a bottom 220. The main block 212 also includes a front face 222 and a rear face 224. The striking block 226 extends outwardly from the rear face 224, and the reference block 232 extends outwardly from the front face 222.

The striking block 226 includes an upper striking face 228 and a lower striking face 230. The striking faces 228 and 230 are set at an angle, with respect to the longitudinal alignment of the reference block 232, as will be discussed in detail below.

The striking surface 228 may be referred to as an extracting striking face, and the lower striking surface 230 may be referred to as a setting striking surface.

Extending outwardly from the front face 222 is the reference block 232. The reference block 232 includes an upper reference arm 234, a lower reference arm 236, and a connecting arm 238.

Extending outwardly from the lower portion of the main block 212, generally outwardly from the bottom surface 220, is an extractor pin 240. The axial length of the extractor pin 240 is substantially less than the axial length of the reference block 232 so that the lower reference arm 236 may be conveniently disposed on the top of a tooth while the tip of the extractor pin 240 is disposed against a pin to be extracted. This has been discussed above in conjunction with the apparatus 160, and is also applicable, of course, to the apparatus 100.

Extending outwardly from the side 216 of the main block 212, adjacent to the top surface 218 of the main block 212, is a holder boss 244. The holder boss 244 extends laterally outwardly from the main block 212. The holder boss 244 includes a front face 246. A pin holding socket 248 extends inwardly from the front face 246. The socket 248, of course, receives a pin to be used to secure a tooth to a shank, as discussed above in conjunction with tool apparatus 100, and as generally illustrated in FIGS. 1, 2, etc.

Adjacent to the holder boss 244, and extending outwardly from the main boss 212, and outwardly from the front face 222 of the main block 212, is a setting block 250. The setting block 250 includes a front setting face 252. It will be noted, as best shown in FIGS. 12 and 13, the setting block 250, and particularly its front face 252, extend outwardly, or forwardly, of the holder boss 244. After the pin is initially set, or after it has been set within a tooth and shank sufficiently to have it removed from the socket 248, the front face 252 of the setting block 250 may then be disposed against the pin, and the striking surface 230 is then struck with an appropriate hammer to continue and to complete the pin setting operation.

As previously discussed, the striking faces 228 and 230 are disposed at angular orientations with respect to the longitudinal axis of the extractor pin 240 and the longitudinal axis of the socket 248, and they are not parallel to the front face 252 of the setting block 250. This is substantially the same as discussed above for the striking faces 178 and 180 of the tool apparatus 160 and for the striking faces 108 and 110 of the tool 100. Again, the angular orientation of the striking faces prevents undesirable hopping or jumping of the tool, which generally occurs when a tool is struck generally parallel to, and aligned with, the direction or force of the blow with respect to the desired direction that the tool will be moving.

In comparing tool apparatus 160 and 210, it is obvious that tool apparatus 210 is designed primarily to be cast in one piece, while tool apparatus 160 may, but need not, be cast from one piece. There are advantages and disadvantages to different types of fabrication, but the casting process is relatively inexpensive, and accordingly the tool apparatus 210 is preferable to the tool apparatus 160 in this regard.

Again, the distance between the extractor pin 240 and the lower reference arm 236 is dimensioned to be the maximum distance expected between the top of a tooth and the appropriate alignment with the hole and the tooth which receives a pin. Similarly, the distance between the socket 248 and the top of the upper reference arm 234 is substantially the same distance as between the bottom of the reference arm 236 and the extractor pin 240. Also, again, if the distance between the top of a tooth of any particular tooth and its hole or pin is less than the distance between the arms of the reference block 232 and the extractor pin 240 or socket 244, then the tool apparatus 210 may be conveniently angularly oriented until the appropriate reference arm is disposed on the top of the tooth with either the extractor pin 240 or the pin and socket 244, or the pin against the front setting face 252, is appropriately aligned. Then the appropriate striking surface, either the striking surface 228 or the striking surface 230, is appropriately struck to accomplish the desired task. This is, of course, substantially as discussed above with respect to the tool apparatus 160, and is also appropriate for the tool apparatus 100.

Within the reference block 232 is a space 260. The space 260 is defined by the main block 212 and the elements 234, 236, and 238 which comprise the reference block 232. The space 260 conveniently receives the fingers of a user for purposes of holding the apparatus 210 while striking the faces 228 and/or 230. Actually, either the upper reference arm 234 or the lower reference arm 236 will be held by a user during the striking or impacting procedure.

Referring to FIGS. 5 and 6 and FIGS. 7 and 10, it will be noted that the planes of the striking or impact faces for both removing or extracting pins and setting or inserting pins is disposed in or at a non-perpendicular angle or orientation with respect to the desired direction of movement of the tools in performing their particular functions in response to hammer blows on the striking or impact faces. This has been discussed above. The striking or impact faces are oriented such that the force of a hammer blow is directed towards a face at an acute angle to the longitudinal axis of movement of the tool. In other words, a line drawn or extending perpendicular to an impact or striking face intersects the longitudinal axis of the tool at an acute angle.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Tool apparatus for inserting and extracting a pin securing a tooth to a shank, comprising, in combination:
   main block means, including
      a main block,
      a bottom surface,
      a top surface,
      a first striking face comprising a first end of the main block and adapted to be struck when setting a pin, and
      a second striking face comprising a second end of the main block and adapted to be struck when extracting a pin;
   holder means secured to the main block means, including
      a holder block secured to and extending downwardly from the bottom surface,
      a socket for holding a pin for the initial setting of the pin secured to the holder block and spaced apart from the bottom surface a first predetermined distance, and
      a setting face laterally adjacent to the socket and adapted to be disposed against the pin after the initial setting of the pin for completing the setting of the pin, and
   extractor means secured to the main block means for extracting a pin, including
      an extractor block secured to and extending upwardly from the top surface, and
      an extractor pin secured to the extractor block and extending outwardly therefrom generally parallel to the top surface of the main block means and spaced apart from the top surface a second predetermined distance, which distance is substantially the same as the first predetermined distance.

2. The apparatus of claim 1 in which the bottom surface is adapted to be disposed on the tooth while the pin is being set.

3. The apparatus of claim 1 in which the top surface is adapted to be disposed on the tooth while the pin is being extracted.

4. The apparatus of claim 1 in which the socket of the holder means includes a longitudinal axis, and the longitudinal axis is generally parallel to the bottom surface in order to properly orient and hold the pin during the initial setting of the pin.

5. The apparatus of claim 1 in which the holder block extends downwardly from the bottom surface between the first and second striking faces.

6. The apparatus of claim 5 in which the setting face comprises a front face of the holder block.

7. The apparatus of claim 1 in which the socket extends internally outwardly from the front face.

8. The apparatus of claim 1 in which the extractor block extends upwardly from the top surface between the first and second striking faces.

9. Tool apparatus for extracting and inserting a pin securing a tooth to a shank, comprising, in combination:
   a main block,
   an extractor pin secured to the main block for extracting a pin;
   setting means secured to the main block for holding a pin and for setting the pin;
   reference means secured to the main block, including
      a first reference arm disposed a predetermined distance from the extracting pin, and
      a second reference arm disposed the predetermined distance from the setting means; and
   striking face means secured to the main block and adapted to be impacted for extracting a pin and for setting a pin.

10. The apparatus of claim 9 in which the setting means includes a socket for holding a pin.

11. The apparatus of claim 9 in which the setting means includes a setting face adapted to be disposed against a pin while setting the pin.

12. The apparatus of claim 11 in which the setting means includes a socket disposed adjacent to the setting face for initially holding the pin for setting.

13. Tool apparatus for inserting and removing pins used to secure elements together, comprising, in combination:
   main block means movable for inserting and removing pins;
   extractor means secured to the main block means and extending outwardly therefrom for extracting a securing pin;
   a first striking face on the main block means for striking to cause the extractor pin to move longitudinally to extract the securing pin when struck;
   a first surface fixedly secured to the main block means against which the securing pin is disposed for inserting the securing pin; and
   a second striking face on the main block means for striking to insert the securing pin disposed against the first surface.

14. The apparatus of claim 13 in which the extractor means has a longitudinal axis and it moves in a direction generally parallel to the longitudinal axis when the first striking face is struck.

15. The apparatus of claim 13 in which the first striking face is disposed at an angle other than perpendicular to the longitudinal axis.

16. The apparatus of claim 13 in which the main block means includes a holder boss, and the first surface is disposed on the holder boss.

17. The apparatus of claim 13 in which the main block means includes a first portion spaced apart from the extractor means a first predetermined distance, and a second portion spaced apart from the first surface a second predetermined distance for providing the predetermined distance between the main block means and the extractor means and the first surface, respectively.

18. The apparatus of claim 13 in which the main block means includes reference block means to provide a predetermined spacing between the extractor means and the reference block means and between the first surface and the reference block means.

19. The apparatus of claim 13 in which the extractor means has a first axial length and the reference block means has a second axial length which is greater than the first axial length.

* * * * *